US007957973B2

(12) United States Patent
Tanaka et al.

(10) Patent No.: US 7,957,973 B2
(45) Date of Patent: Jun. 7, 2011

(54) AUDIO SIGNAL INTERPOLATION METHOD AND DEVICE

(75) Inventors: Masakiyo Tanaka, Kawasaki (JP); Masanao Suzuki, Kawasaki (JP); Miyuki Shirakawa, Fukuoka (JP); Takashi Makiuchi, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 963 days.

(21) Appl. No.: 11/878,596

(22) Filed: Jul. 25, 2007

(65) Prior Publication Data

US 2008/0071541 A1 Mar. 20, 2008

(30) Foreign Application Priority Data

Sep. 20, 2006 (JP) ..... 2006-254425

(51) Int. Cl.
*G10L 13/00* (2006.01)

(52) U.S. Cl. ..... 704/265; 704/205; 704/268

(58) Field of Classification Search ..... 704/265, 704/205, 268

See application file for complete search history.

(56) References Cited

U.S. PATENT DOCUMENTS 5,226,084 A * 7/1993 Hardwick et al. ..... 704/219
2006/0004583 A1 1/2006 Herre et al.

FOREIGN PATENT DOCUMENTS

JP 2002-041089 2/2002

OTHER PUBLICATIONS

T. Virtanen et al., "Separation of Harmonic Sound Sources Using Sinusoidal Modeling" Acoustics, Speech, and Signal Processing, IEEE, Jun. 5, 2000; pp. 765-768.

The Extended European Search Report issued Jul. 31, 2007 in corresponding European Patent Application No. 07113137.9.

* cited by examiner

*Primary Examiner* — Jakieda R Jackson
(74) *Attorney, Agent, or Firm* — Fujitsu Patent Center

(57) ABSTRACT

An audio signal interpolation device comprises a spectral movement calculation unit which determines a spectral movement which is indicative of a difference in each of spectral components between a frequency spectrum of a current frame of an input audio signal and a frequency spectrum of a previous frame of the input audio signal stored in a spectrum storing unit. An interpolation band determination unit determines a frequency band to be interpolated by using the frequency spectrum of the current frame and the spectral movement. A spectrum interpolation unit performs interpolation of spectral components in the frequency band for the current frame by using either the frequency spectrum of the current frame or the frequency spectrum of the previous frame.

15 Claims, 10 Drawing Sheets

AUDIO SIGNAL INTERPOLATION METHOD AND DEVICE

CROSS-REFERENCE TO RELATED APPLICATIONS

This application is based upon and claims the benefit of priority of Japanese patent application No. 2006-254425, filed on Sep. 20, 2006, the entire contents of which are herein incorporated by reference.

BACKGROUND OF THE INVENTION

1. Field of the Invention

This invention generally relates to an audio signal interpolation method and device, and more particularly to an audio signal interpolation method and device adapted to improve the sound quality by interpolating the skipped spectral components to an audio signal in which some spectral components are skipped.

2. Description of the Related Art

In recent years, the service of digital distribution of music through the Internet is spreading quickly. Usually, in this music distribution service, compression and distribution of an audio signal is commonly performed using the audio coding technique, such as AAC (Advanced Audio Coding) or MP3 (MPEG1 Audio Layer 3).

The above-mentioned audio coding technique of AAC or MP3 is characterized by compressing the audio signal by skipping the spectral components that are not important for the hearing based on the subjectivity of the human being. FIG. 1A shows the frequency spectrum before encoding, and FIG. 1B shows the frequency spectrum after encoding. Suppose that the spectral components which are indicated by the dotted lines in FIG. 1B are skipped.

In this specification, as shown in FIG. 1A and FIG. 1B, the whole audio signal which is expressed by the amplitude levels of respective frequencies will be referred to as frequency spectrum, and the amplitude level of each frequency will be referred to as a spectral component.

Skipping of these spectral components is performed on the basis of a frame which is a collection of audio signal for a plurality of samples, and which spectral components are skipped is determined independently for every frame.

For example, in the encoded spectrum of the frame at the time instant t, the spectral component indicated by the dotted line in FIG. 2A is not skipped, whereas, in the encoded spectrum of the frame at the time instant (t+1), the spectral component indicated by the dotted line in FIG. 2B is skipped. Thus, the phenomenon in which the spectral components move violently may arise.

Since the hearing of the human being is very sensitive to movement of spectral components, the movement of spectral components induces to the human hearing the sense of incongruity. And this causes the sound quality to deteriorate. In order to prevent the deteriorating of the sound quality due to the skipping of spectral components, it is demanded to provide a method of interpolating the skipped spectral components appropriately.

For example, Japanese Patent No. 3576936 discloses a method of interpolating the skipped spectral components. In the method of Japanese Patent No. 3576936, a band where a spectral component does not exist is determined as the band to be interpolated. Then the determined band is interpolated using the spectral components of a corresponding band in the preceding or following frame which is, equivalent to the determined band, or the spectral components of a low-frequency-side band adjacent to the determined band.

FIG. 3A shows the frequency spectrum before interpolation and FIG. 3B shows the way the determined band is interpolated using the spectral components of a low-frequency-side band adjacent to the determined band.

In the conventional method mentioned above, the interpolation is performed by determining a band where a spectral component does not exist as the band to be interpolated. However, there may be two kinds of band where a spectral component does not exist: the skipped band in which spectral components are skipped by the encoding; and the vacancy band in which a spectral component does not exist primarily. Although the skipped band is a band which should be interpolated, the vacancy band is a band which must not be interpolated.

However, in the case of the above-mentioned conventional method, both the skipped band and the vacancy band may be interpolated. Thus, there is a problem that the sound quality will deteriorate because the unnecessary interpolation is performed with respect to the vacancy band where a spectral component does not exist primarily.

SUMMARY OF THE INVENTION

According to one aspect of the invention, there is provided an improved audio signal interpolation method and device in which the above-described problems are eliminated.

According to one aspect of the invention, there is provided an audio signal interpolation method and device which is adapted to determine correctly a frequency band which should be interpolated, and prevent the degradation of the sound quality due to performance of the unnecessary interpolation.

In an embodiment of the invention which solves or reduces one or more of the above-mentioned problems, there is provided an audio signal interpolation method comprising: determining a spectral movement which is indicative of a difference in each of spectral components between a frequency spectrum of a current frame of an input audio signal and a frequency spectrum of a previous frame of the input audio signal stored in a spectrum storing unit; determining a frequency band to be interpolated by using the frequency spectrum of the current frame and the spectral movement; and performing interpolation of spectral components in the frequency band for the current frame by using either the frequency spectrum of the current frame or the frequency spectrum of the previous frame.

In an embodiment of the invention which solves or reduces one or more of the above-mentioned problems, there is provided an audio signal interpolation device comprising: a spectral movement calculation unit determining a spectral movement which is indicative of a difference in each of spectral components between a frequency spectrum of a current frame of an input audio signal and a frequency spectrum of a previous frame of the input audio signal stored in a spectrum storing unit; an interpolation band determination unit determining a frequency band to be interpolated by using the frequency spectrum of the current frame and the spectral movement; and a spectrum interpolation unit performing interpolation of spectral components in the frequency band for the current frame by using either the frequency spectrum of the current frame or the frequency spectrum of the previous frame.

According to this embodiment of the invention, a frequency band which should be interpolated can be determined correctly, and the unnecessary interpolation is not performed, thereby preventing the degradation of the sound quality.

According to the embodiments of the invention, it is possible to correctly determine a frequency band which should be interpolated, and it is possible to prevent the degradation of the sound quality due to performance of the unnecessary interpolation.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

A description will now be given of an embodiment of the invention with reference to the accompanying drawings.

The non-encoded audio signal (or the original sound) will be attenuated in the amplitude of respective frequencies moderately, whereas the encoded audio signal in which some spectral components are skipped by the encoding will be attenuated in the amplitude of spectral components rapidly. According to the principle of this invention, a frequency band that should be interpolated is determined using the magnitude of a spectral movement (which is a movement in the amplitude of spectral components) in addition to the magnitude of spectral components, so that the band where the spectral components are skipped by the encoding can be determined correctly prior to performing the interpolation for the band.

Figure 1B:
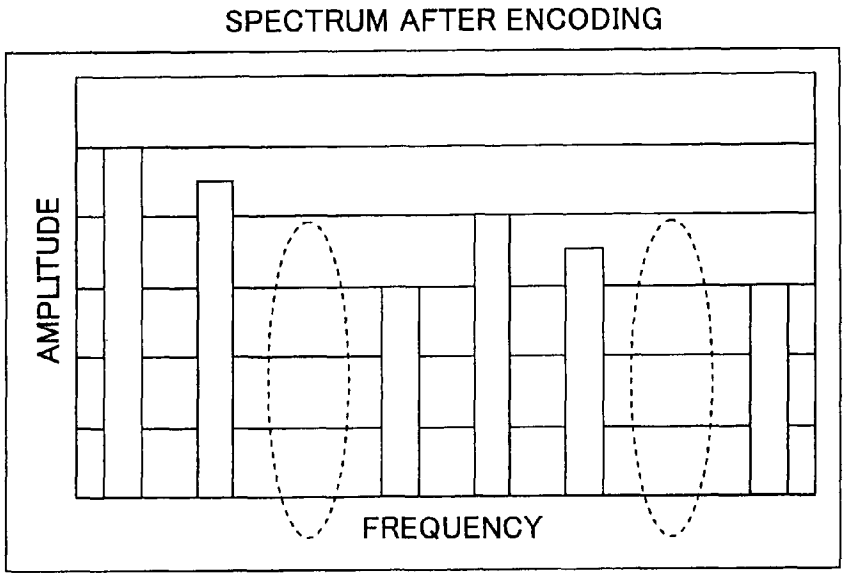
FIG. 1A and FIG. 1B are diagrams for explaining skipping of spectral components.
Figure 1A:
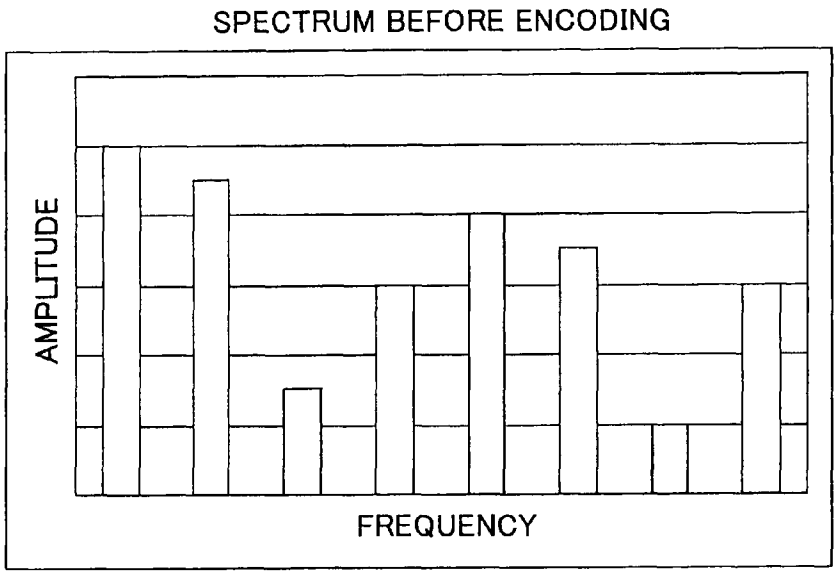
Figure 2B:
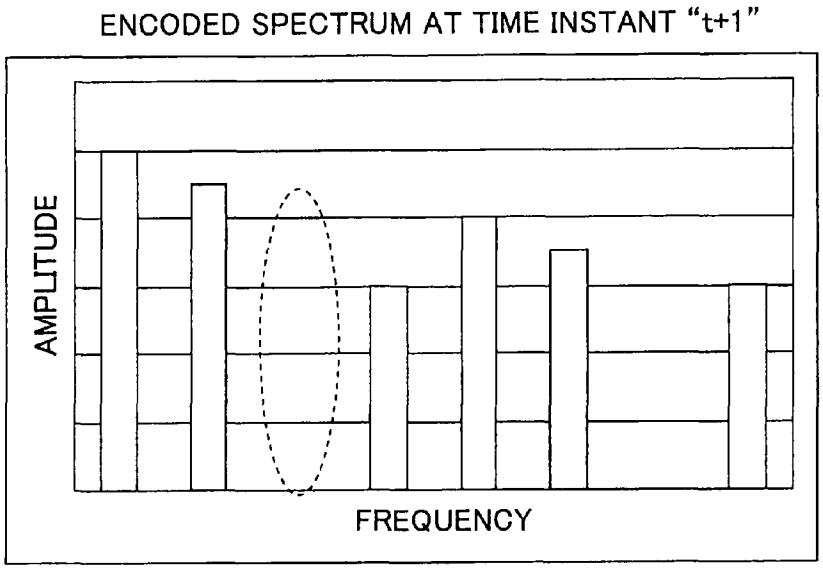
FIG. 2A and FIG. 2B are diagrams for explaining skipping of spectral components.
Figure 2A:
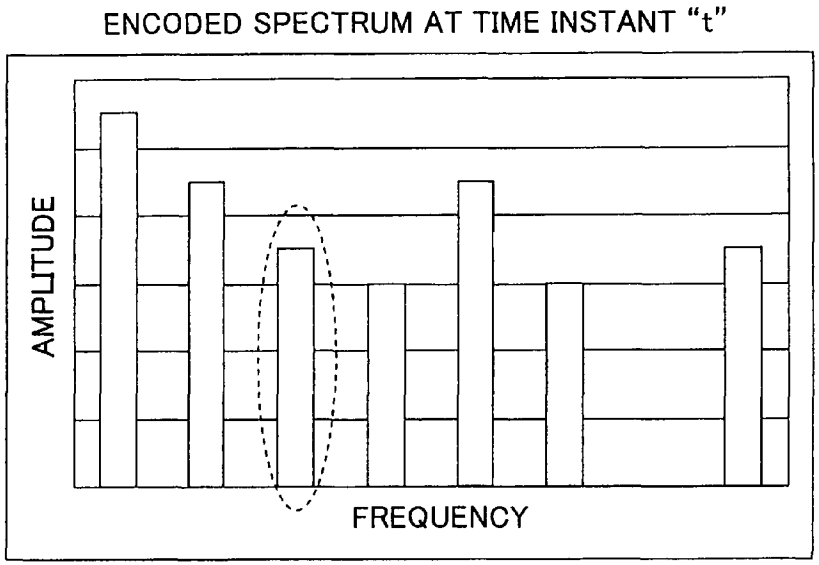
Figure 3B:
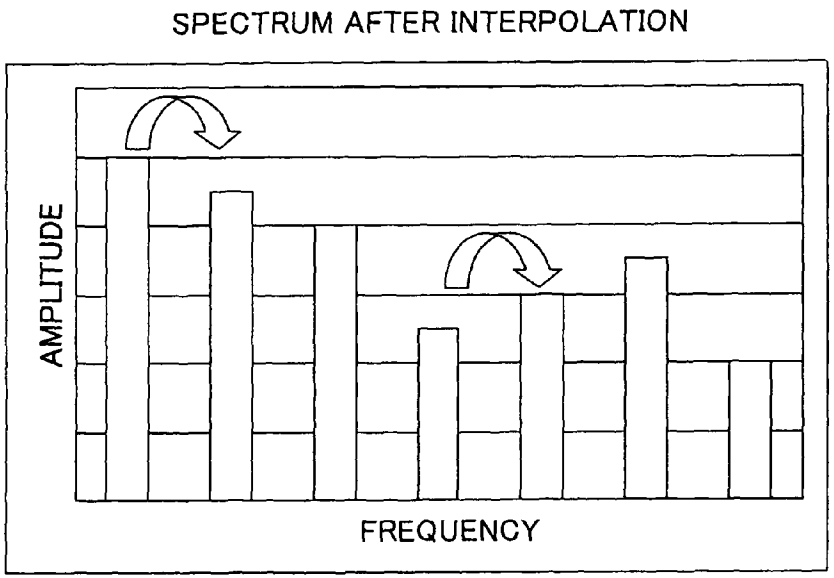
FIG. 3A and FIG. 3B are diagrams for explaining interpolation of spectral components.
Figure 3A:
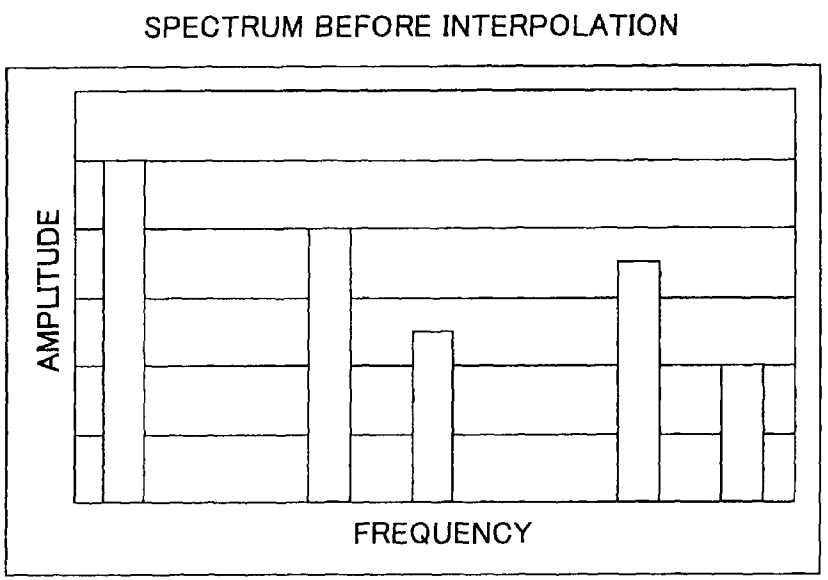
Figure 4:
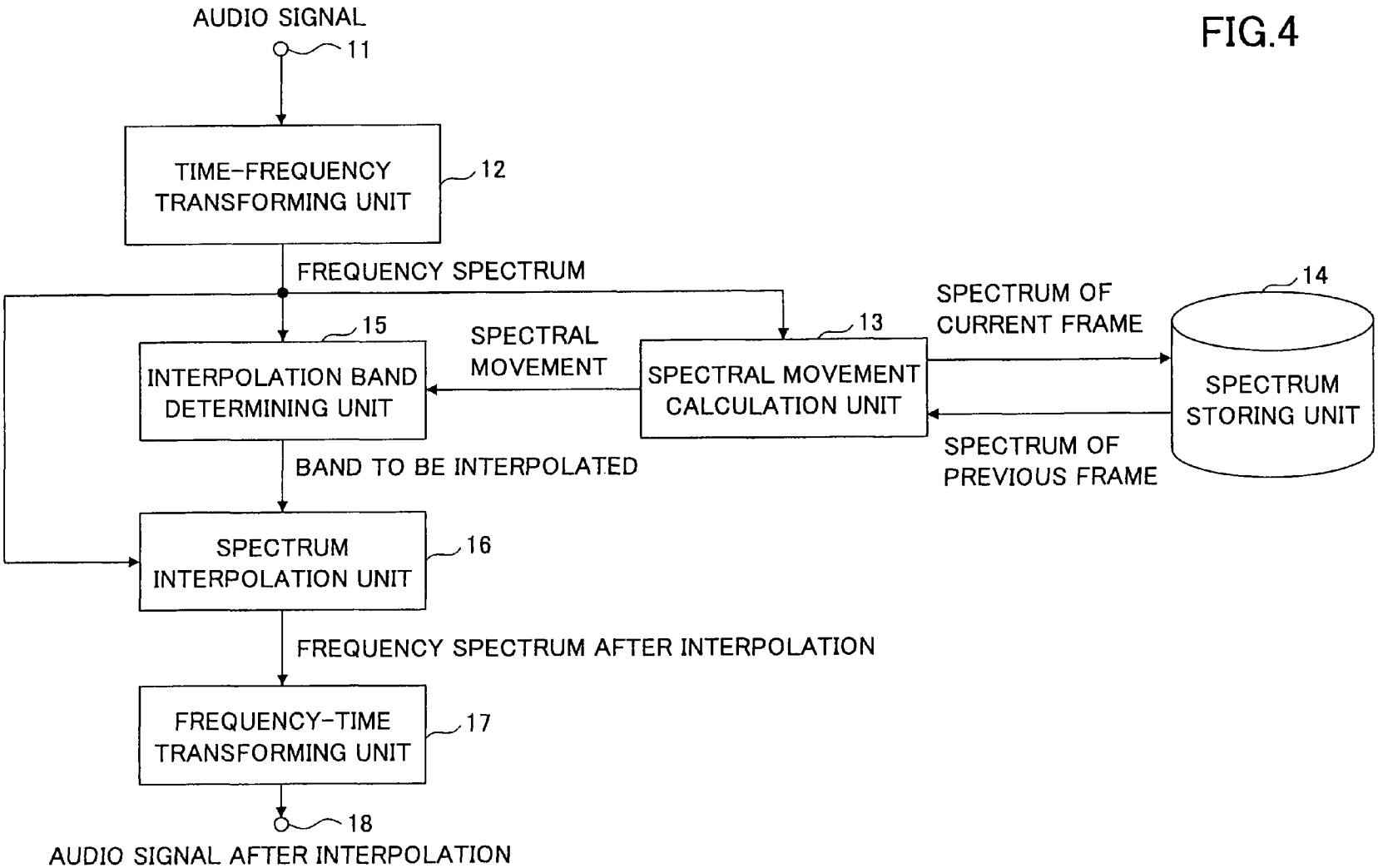
FIG. 4 is a block diagram showing the composition of an audio signal interpolation device in an embodiment of the invention.

FIG. 4 is a block diagram showing the composition of an audio signal interpolation device in an embodiment of the invention.

In the audio signal interpolation device of FIG. 4, a time-domain audio signal which is created by decoding the encoded audio data is inputted from an input terminal 11 on the basis of a frame which is a collection of audio signal for a plurality of samples. And this audio signal is supplied to a time-frequency transforming unit 12.

In the time-frequency transforming unit 12, the time-domain audio signal is transformed into a frequency-domain audio signal for every frame. Any of the known transforming methods, such as FFT (Fast Fourier Transform) and MDCT (Modified Discrete Cosine Transform), may be used for the time-frequency transforming by the time-frequency transforming unit 12. The frequency-domain audio signal generated (which is a frequency spectrum) is supplied to each of a spectral movement calculation unit 13, an interpolation band determining unit 15, and a spectrum interpolation unit 16, respectively.

The spectral movement calculation unit 13 determines a spectral movement by using the frequency spectrum received from the time-frequency transforming unit 12 and the frequency spectrum of the previous frame read from a spectrum storing unit 14, and supplies the spectral movement to the interpolation band determining unit 15.

The spectral movement determined by the spectral movement calculation unit 13 may be any of the amount of movement of spectral components from the previous frame to the current frame, the difference between the amount of movement of spectral components of the previous frame (or the amount of movement of spectral components from the further preceding frame to the previous frame) and the amount of movement of spectral components of the current frame (or the amount of movement of spectral components from the previous frame to the current frame), and the difference between the amount of movement from the spectral component of concern to the adjacent spectral component in the previous frame (or the difference in amplitude between the spectral component of concern and the adjacent spectral component in the previous frame) and the amount of movement from the spectral component of concern to the adjacent spectral component in the current frame (or the difference in amplitude of the spectral component of concern and the adjacent spectral component in the current frame).

After the spectral movement of the current frame is calculated, the spectral movement calculation unit 13 stores the frequency spectrum of the current frame into the spectrum storing unit 14 in order to calculate a spectral movement of the following frame. The determination of a spectral movement may be performed for every frequency band in which a plurality of adjacent spectral components are included.

The interpolation band determining unit 15 determines a frequency band to be interpolated based on the spectral movement received from the spectral movement calculation unit 13 as well as the frequency spectrum received from the time-frequency transforming unit 12. The interpolation band determining unit 15 may use any of the following methods for determining a frequency band to be interpolated, which will be given below.

Figure 5:
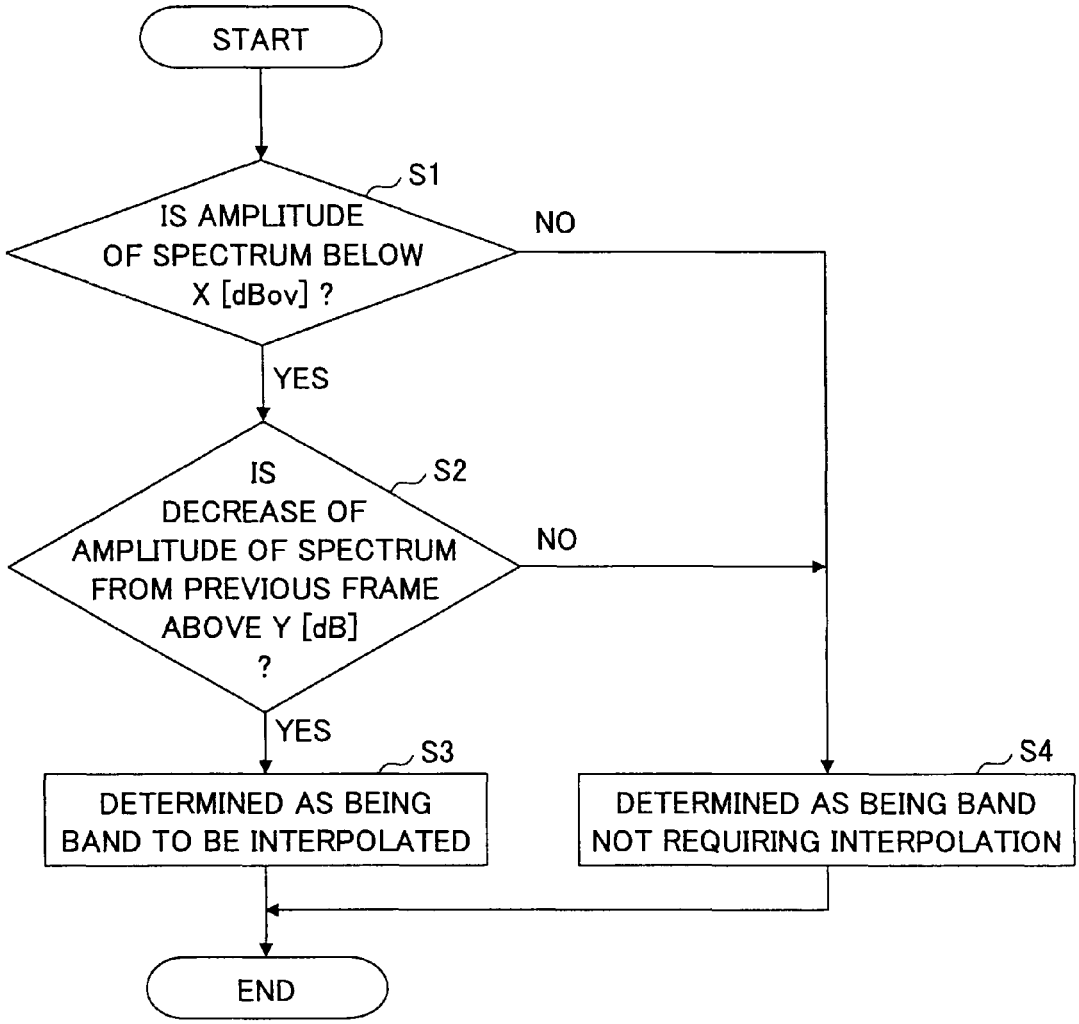
FIG. 5 is a flowchart for explaining an interpolation band determining method in an embodiment of the invention.

FIG. 5 is a flowchart for explaining an interpolation band determining method used by the interpolation band determining unit 15 in an embodiment of the invention.

Upon start of the interpolation band determining method of FIG. 5, the interpolation band determining unit 15 determines whether the amplitude (amplitude level) of spectral components is below a predetermined threshold X [dBov] at step S1.

The interpolation band determining unit 15 determines whether a decrease of the amplitude of the spectral components from the previous frame to the current frame (which is a spectral movement) is above a predetermined threshold Y [dB] at step S2.

When the amplitude of spectral components is below the threshold X [dBov] and the decrease of the amplitude of the spectral components from the previous frame to the current frame is above the threshold Y [dB], the frequency band concerned is determined as being a frequency band to be interpolated at step S3.

When the amplitude of spectral components is above the threshold X [dBov], or when the decrease of the amplitude of the spectral components from the previous frame to the current frame is below the threshold Y [dB], the frequency band concerned is determined as being a frequency band which does not require interpolation at step S4. For example, the thresholds X and Y in this embodiment are set to as X=−60 and Y=20.

Figure 6:
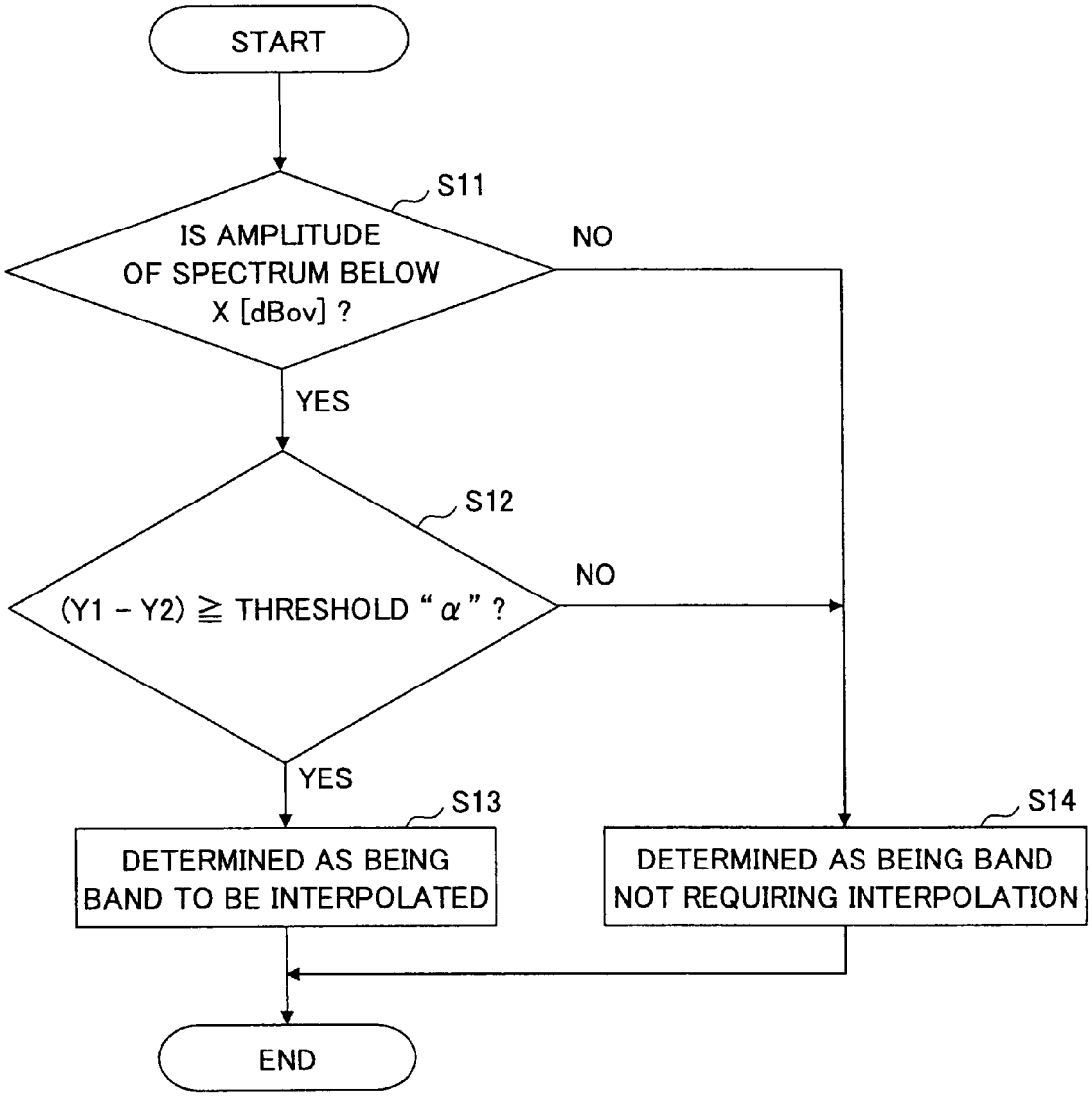
FIG. 6 is a flowchart for explaining an interpolation band determining method in an embodiment of the invention.

FIG. 6 is a flowchart for explaining an another interpolation band determining method used by the interpolation band determining unit 15 in an embodiment of the invention.

Upon start of the interpolation band determining method of FIG. 6, the interpolation band determining unit 15 determines whether the amplitude of spectral components is below the predetermined threshold X [dBov] at step S11.

The interpolation band determining unit 15 determines whether a difference ((Y1-Y2)[dB]) between the amount of movement of spectral components (Y1 [dB]) from the further preceding frame to the previous frame and the amount of movement of spectral components (Y2 [dB]) from the previous frame to the current frame is above a predetermined threshold α at step S12.

When the amplitude of spectral components is below the threshold X [dBov] and the difference (Y1-Y2) [dB] is above the threshold α, the frequency band concerned is determined as being a frequency band to be interpolated at step S13.

When the amplitude of spectral components is above the threshold X [dBov], or when the difference (Y1-Y2) [dB] is below the threshold α, the frequency bands concerned is determined as being a frequency band which does not require interpolation at step S14.

For example, the threshold α in this embodiment is set to 5. In addition, the difference concerning the amount of movement of spectral components from the still further preceding frame to the further preceding frame may be used instead.

Figure 7:
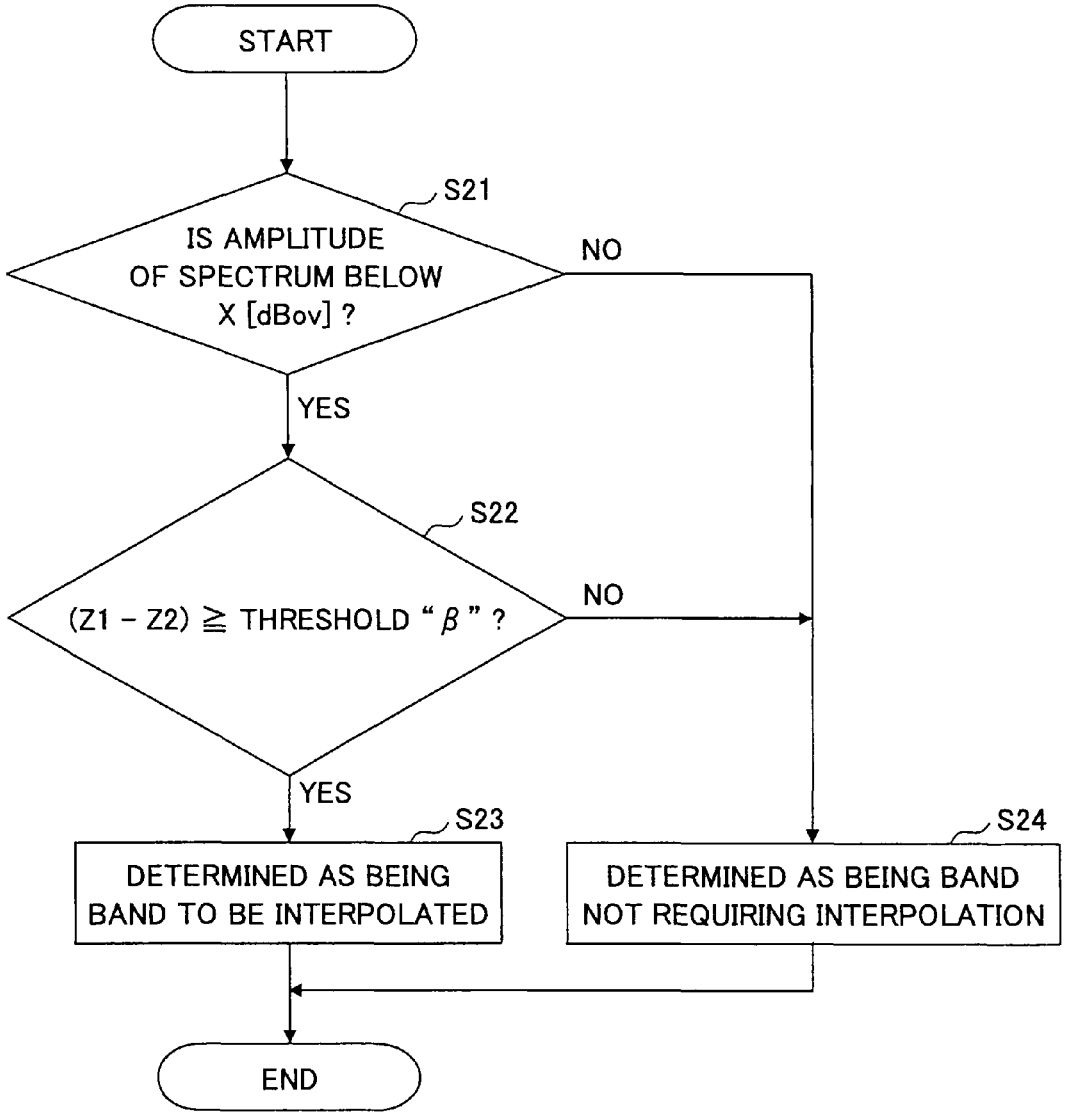
FIG. 7 is a flowchart for explaining an interpolation band determining method in an embodiment of the invention.

FIG. 7 is a flowchart for explaining an another interpolation band determining method used by the interpolation band determining unit 15 in an embodiment of the invention.

Upon start of the interpolation band determining method of FIG. 6, the interpolation band determining unit 15 determines whether the amplitude of spectral components is below the predetermined threshold X [dBov] at step S21.

The interpolation band determining unit 15 determines whether a difference ((Z1-Z2) [dB]) between a difference in amplitude between the spectral component of concern and the adjacent spectral component in the previous frame (Z1 [dB]) and a difference in amplitude between the spectral component of concern and the adjacent spectral component in the current frame (Z2 [dB]) is above a predetermined threshold β at step S22.

When the amplitude of spectral components is below the threshold X [dBov] and the difference (Z1-Z2) [dB] is above the threshold β, the frequency band concerned is determined as being a frequency band to be interpolated at step S23.

When the amplitude of spectral components is above the threshold X [dBov], or when the difference (Z1-Z2) [dB] is below the threshold β, the frequency band concerned is determined as being a frequency band which does not require interpolation at step S24. For example, the threshold β in this embodiment is set to be 5.

In the above-described embodiments of FIG. 5-FIG. 7, each of the thresholds X and Y is considered as a fixed value. Alternatively, a variable threshold which has a different value depending on the frequency band concerned may be used instead. For example, the value of the variable threshold X for a high frequency band of an input audio signal is set to as X=−50, and the value of the variable threshold X for a low frequency band of the input audio signal is set to as X=−60. Similarly, the value of the variable threshold Y for a high frequency band of an input audio signal is set to as Y=20, and the value of the variable threshold Y for a low frequency band of the input audio signal is set to as Y=15. Similarly, it may be set up for each of the thresholds α and β so that the value of the variable threshold for a low frequency band of an input audio signal is smaller than the value of the variable threshold for a high frequency band of the input audio signal.

In addition, each of the thresholds X, Y, α, and β may be changed dynamically such that a value of the threshold is generated by multiplying the average power of an input audio signal over all the bands of the frequency spectrum of the current frame by a predetermined coefficient. Alternatively, one of different threshold values may be selectively used depending on the audio coding method concerned (such as AAC or MP3). Alternatively, the audio signal interpolation device may be configured so that the user is permitted to change each value of the thresholds X, Y, α, and β arbitrarily.

Referring back to FIG. 4, the spectrum interpolation unit 16 interpolates the spectral components of the frequency band determined by the interpolation band determining unit 15.

The method of interpolation used by the spectrum interpolation unit 16 may be the same as the conventional method. Namely, in the method of interpolation by the spectrum interpolation unit 16, the frequency spectrum of the current frame which is determined as the frequency band to be interpolated is interposed using the spectral components of a corresponding band in the preceding or following frame for the band to be interpolated in the current frame. Alternatively, another interpolation method may be used in which the spectral components of a low-frequency-side band in the current frame are copied and they are interpolated.

The frequency-time transforming unit 17 performs the frequency-time transforming for the frequency spectrum after interpolation for every frame, to restore the time-domain audio signal so that the time-domain audio signal is outputted to an output terminal 18.

In this embodiment, the frequency band to be interpolated is determined using the magnitude of a spectral movement (which is a movement in the amplitude of spectral components from the previous frame) in addition to the magnitude of spectral components, and the interpolation for the determined band is performed. Thus, it is possible to prevent interpolating of a frequency band which must not be interpolated, and the degradation of the sound quality due to the interpolation for the incorrect frequency band does not arise. The interpolation for the frequency band where spectral components are skipped by encoding can be performed appropriately, to restore the audio signal in the form near the spectrum before encoding, and the sound quality can be improved.

Figure 8:
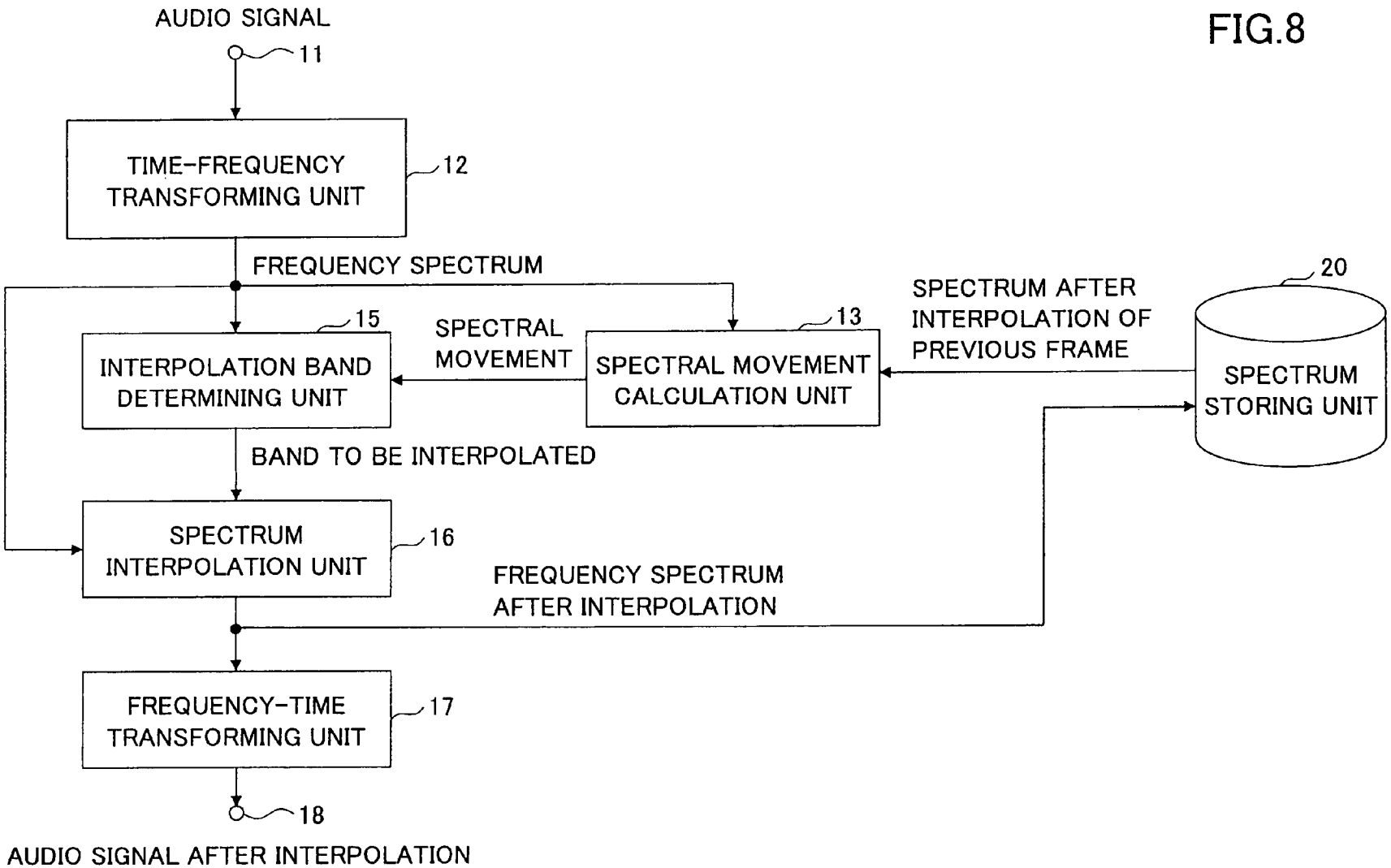
FIG. 8 is a block diagram showing the composition of an audio signal interpolation device in an embodiment of the invention.

FIG. 8 is a block diagram showing the composition of an audio signal interpolation device in an embodiment of the invention.

In FIG. 8, the elements which are the same as corresponding elements in FIG. 4 are designated by the same reference numerals.

In the audio signal interpolation device of FIG. 8, a time-domain audio signal which is created by decoding the encoded audio data is inputted from an input terminal 11 on the basis of a frame which is a collection of audio signal for a plurality of samples. And this audio signal is supplied to the time-frequency transforming unit 12.

In the time-frequency transforming unit 12, the time-domain audio signal is transformed into a frequency-domain audio signal for every frame. Any of the known transforming methods, such as the FFT or the MDCT, may be used for the time-frequency transforming by the time-frequency transforming unit 12. The generated frequency-domain audio signal (which is a frequency spectrum) is supplied to each of the spectral movement calculation unit 13, the interpolation band determining unit 15, and the spectrum interpolation unit 16, respectively.

The spectral movement calculation unit 13 determines a spectral movement by using the frequency spectrum of the current frame received from the time-frequency transforming unit 12 and the frequency spectrum of the previous frame read from a spectrum storing unit 20, and supplies the spectral movement to the interpolation band determining unit 15.

The spectral movement determined by the spectral movement calculation unit 13 may be any of the amount of movement of spectral components from the previous frame to the current frame, the difference between the amount of movement of spectral components of the previous frame (or the amount of movement of spectral components from the further preceding frame to the previous frame) and the amount of movement of spectral components of the current frame (or the amount of movement of spectral components from the previous frame to the current frame), and the difference between the amount of movement from the spectral component of concern to the adjacent spectral component in the previous frame (or the difference in amplitude between the spectral component of concern and the adjacent spectral component in the previous frame) and the amount of movement from the spectral component of concern to the adjacent spectral component in the current frame (or the difference in amplitude of the spectral component of concern and the adjacent spectral component in the current frame).

The spectral movement calculation unit 13 in this embodiment does not store the frequency spectrum of the current frame into the spectrum storing unit 20 after the spectral movement of the current frame is calculated. The determination of a spectral movement may be performed for every frequency band in which a plurality of adjacent spectral components are included.

The interpolation band determining unit 15 determines a frequency band to be interpolated based on the spectral movement received from the spectral movement calculation unit 13 as well as the frequency spectrum received from the time-frequency transforming unit 12. The interpolation band determining unit 15 may use any of the interpolation band determining methods shown in FIG. 5-FIG. 7.

The spectrum interpolation unit 16 interpolates the spectrum components of the frequency band determined by the interpolation band determining unit 15. The method of interpolation used by the spectrum interpolation unit 16 may be the same as the conventional method. Namely, in the method of interpolation by the spectrum interpolation unit 16, the frequency spectrum of the current frame which is determined as the frequency band to be interpolated is interposed using the spectral components of a corresponding band in the preceding or following frame for the band to be interpolated in the current frame. Alternatively, another interpolation method may be used in which the spectral components of a low-frequency-side band in the current frame are copied and they are interpolated.

The spectrum interpolation unit 16 stores the frequency spectrum of the current frame after interpolation into the spectrum storing unit 20. The frequency-time transforming unit 17 performs the frequency-time transforming of the frequency spectrum after interpolation for every frame, and restores the time-domain audio signal so that the time-domain audio signal is outputted from the output terminal 18.

In this embodiment, the frequency spectrum of the current frame after interpolation is stored into the spectrum storing unit 20, and the determination of a spectral movement is performed using the frequency spectrum of the previous frame after interpolation read from the spectrum storing unit 20. Thus, the interpolation for the band where spectral components are skipped by encoding can be performed appropriately when the spectral components of the same band in a plurality of continuous frames are skipped by encoding. The accuracy of the interpolation can be made better, the frequency spectrum before encoding can be restored, and the sound quality can be improved.

Figure 9:
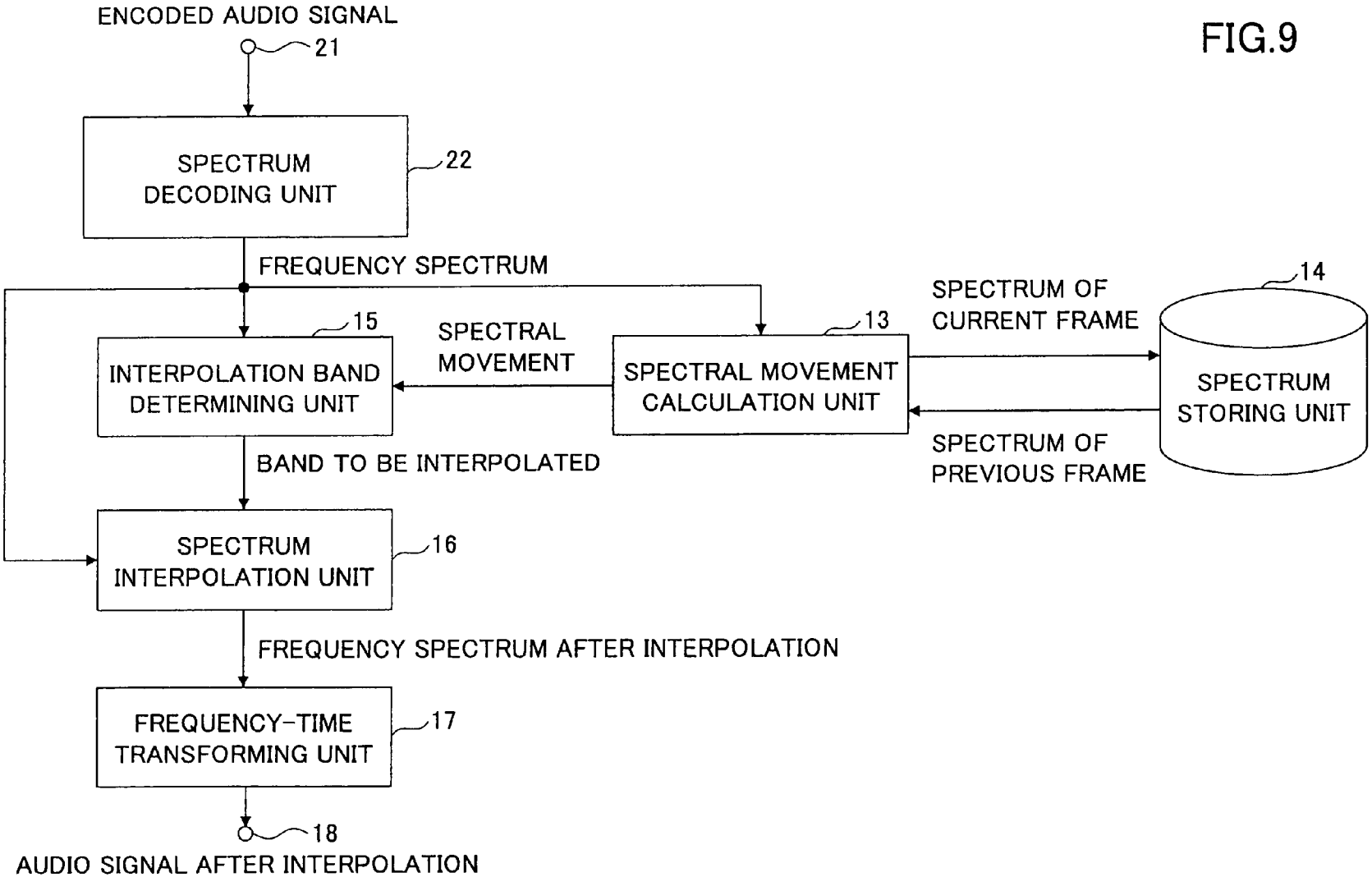
FIG. 9 is a block diagram showing the composition of an audio signal interpolation device in an embodiment of the invention.

FIG. 9 is a block diagram showing the composition of an audio signal interpolation device in an embodiment of the invention.

In FIG. 9, the elements which are the same as corresponding elements in FIG. 4 are designated by the same reference numerals.

In the audio coding technique of AAC or MP3, the time-domain audio signal (the original sound) is transformed into the frequency-domain audio signal, and some spectral components in the frequency-domain audio signal are skipped, and then encoding is performed to generate the encoded audio data.

In the audio signal interpolation device of FIG. 9, the encoded audio data which is generated by using the audio coding technique of AAC or MP3 is inputted from an input terminal 21. And this encoded audio data is supplied to a spectrum decoding unit 22. The spectrum decoding unit 22 decodes the encoded audio data to generate a frequency-domain audio signal (which is a frequency spectrum). The generated frequency-domain audio signal is supplied on a frame basis to each of the spectral movement calculation unit 13, the interpolation band determining unit 15, and the spectrum interpolation unit 16, respectively.

The spectral movement calculation unit 13 determines a spectral movement by using the frequency spectrum of the current frame received from the spectrum decoding unit 22 and the frequency spectrum of the previous frame read from the spectrum storing unit 14, and supplies the spectral movement to the interpolation band determining unit 15.

The spectral movement determined by the spectral movement calculation unit 13 may be any of the amount of movement of spectral components from the previous frame to the current frame, the difference between the amount of movement of spectral components of the previous frame (or the amount of movement of spectral components from the further preceding frame to the previous frame) and the amount of movement of spectral components of the current frame (or the amount of movement of spectral components from the previous frame to the current frame), and the difference between the amount of movement from the spectral component of concern to the adjacent spectral component in the previous frame (or the difference in amplitude between the spectral component of concern and the adjacent spectral component in the previous frame) and the amount of movement from the spectral component of concern to the adjacent spectral component in the current frame (or the difference in amplitude of the spectral component of concern and the adjacent spectral component in the current frame).

The spectral movement calculation unit 13 in this embodiment stores the frequency spectrum of the current frame into the spectrum storing unit 14 after the spectral movement of the current frame is calculated, in order to calculate a spectral movement of the following frame. The determination of a spectral movement may be performed for every frequency band in which a plurality of adjacent spectral components are included.

The interpolation band determining unit 15 determines a frequency band to be interpolated based on the spectral movement received from the spectral movement calculation unit 13 as well as the frequency spectrum received from the spectrum decoding unit 22. The interpolation band determining unit 15 may use any of the interpolation band determining methods of shown in FIG. 5-FIG. 7.

The spectrum interpolation unit 16 interpolates the spectrum components of the frequency band determined by the interpolation band determining unit 15. The method of interpolation used by the spectrum interpolation unit 16 may be the same as the conventional method. Namely, in the method of interpolation by the spectrum interpolation unit 16, the frequency spectrum of the current frame which is determined as the frequency band to be interpolated is interposed using the spectral components of a corresponding band in the preceding or following frame for the band to be interpolated in the current frame. Alternatively, another interpolation method may be used in which the spectral components of a low-frequency-side band in the current frame are copied and they are interpolated.

The frequency-time transforming unit 17 performs the frequency-time transforming of the frequency spectrum after interpolating for every frame, and restores the time-domain audio signal so that the time-domain audio signal is outputted from the output terminal 18.

In this embodiment, the interpolation is performed for the frequency-domain audio signal containing the encoded audio data which is generated in the frequency domain, prior to restoring of the time-domain audio signal. According to this embodiment, the device or process for performing the time-frequency transform as in the embodiment of FIG. 4 can be omitted, and any analysis error when analyzing a frequency spectrum from a time-domain audio signal as in the embodiment of FIG. 4 does not arise. Thus, the accuracy of the interpolation can be made better, the frequency spectrum before encoding can be restored, and the sound quality can be improved.

Figure 10:
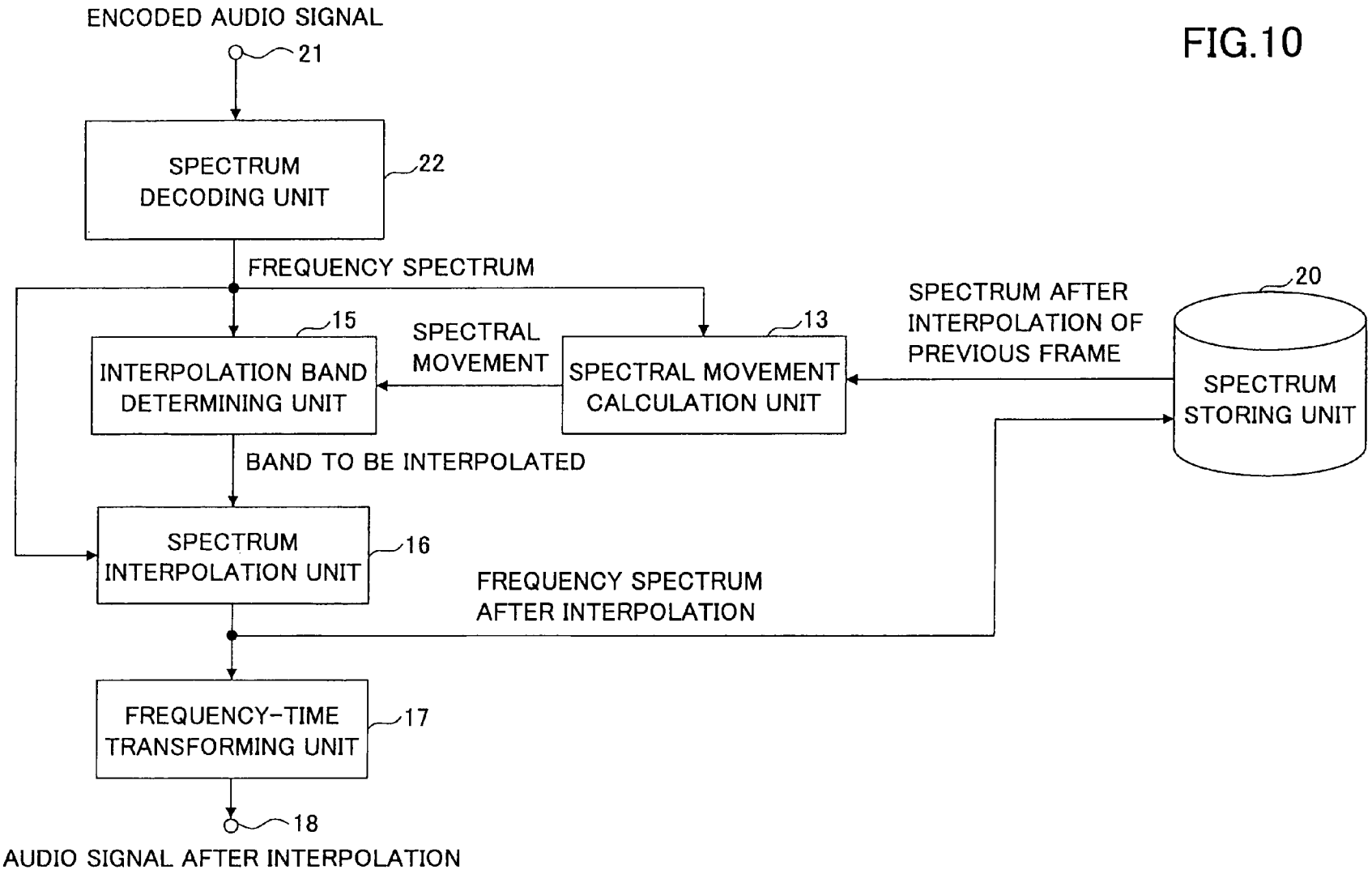
FIG. 10 is a block diagram showing the composition of an audio signal interpolation device in an embodiment of the invention.

FIG. 10 is a block diagram showing the composition of an audio signal interpolation device in an embodiment of the invention.

In FIG. 10, the elements which are the same as corresponding elements in FIG. 4 are designated by to the same reference numerals.

In the audio signal interpolation device of FIG. 10, the encoded audio data which is generated by using the audio coding technique of AAC or MP3 is inputted from the input terminal 21. And this encoded audio signal is supplied to the spectrum decoding unit 22. The spectrum decoding unit 22 decodes the encoded audio data to generate a frequency-domain audio signal (which is a frequency spectrum). The generated frequency-domain audio signal is supplied on a frame basis to each of the spectral movement calculation unit 13, the interpolation band determining unit 15, and the spectrum interpolation unit 16, respectively.

The spectral movement calculation unit 13 determines a spectral movement by using the frequency spectrum of the current frame received from the spectrum decoding unit 22 and the frequency spectrum of the previous frame read from the spectrum storing unit 20, and supplies the spectral movement to the interpolation band determining unit 15.

The spectral movement determined by the spectral movement calculation unit 13 may be any of the amount of movement of spectral components from the previous frame to the current frame, the difference between the amount of movement of spectral components of the previous frame (or the amount of movement of spectral components from the further preceding frame to the previous frame) and the amount of movement of spectral components of the current frame (or the amount of movement of spectral components from the previous frame to the current frame), and the difference between the amount of movement from the spectral component of concern to the adjacent spectral component in the previous frame (or the difference in amplitude between the spectral component of concern and the adjacent spectral component in the previous frame) and the amount of movement from the spectral component of concern to the adjacent spectral component in the current frame (or the difference in amplitude of the spectral component of concern and the adjacent spectral component in the current frame).

The spectral movement calculation unit 13 in this embodiment does not store the frequency spectrum of the current frame into the spectrum storing unit 20 after the spectral movement of the current frame is calculated. The determination of a spectral movement may be performed for every frequency band in which a plurality of adjacent spectral components are included.

The interpolation band determining unit 15 determines a frequency band to be interpolated by using the spectral movement received from the spectral movement calculation unit 13 as well as the frequency spectrum received from the spectrum decoding unit 22. The interpolation band determining unit 15 may use any of the interpolation band determining methods shown in FIG. 5-FIG. 7.

The spectrum interpolation unit 16 interpolates the spectral components of the frequency band determined by the interpolation band determining unit 15. The method of interpolation used by the spectrum interpolation unit 16 may be the same as the conventional method. Namely, in the method of interpolation by the spectrum interpolation unit 16, the frequency spectrum of the current frame which is determined as the frequency band to be interpolated is interposed using the spectral components of a corresponding band in the preceding or following frame for the band to be interpolated in the current frame. Alternatively, another interpolation method may be used in which the spectral components of a low-frequency-side band in the current frame are copied and they are interpolated.

The spectrum interpolation unit 16 stores the frequency spectrum of the current frame after interpolation into the spectrum storing unit 20. The frequency-time transforming unit 17 performs the frequency-time transforming of the frequency spectrum after interpolation for every frame, and restores the time-domain audio signal so that the time-domain audio signal is outputted from the output terminal 18.

In this embodiment, the frequency spectrum of the current frame after interpolation is stored into the spectrum storing unit 20, and the determination of a spectral movement is performed by using the frequency spectrum of the previous frame after interpolation read from the spectrum storing unit 20. Thus, the interpolation for the band where spectral components are skipped by encoding can be performed appropriately when the spectral components of the same band in a plurality of continuous frames are skipped by encoding. The accuracy of the interpolation can be made better, the frequency spectrum before encoding can be restored, and the sound quality can be improved.

The spectrum storing units 14 and 20 in the above embodiments are equivalent to a spectrum storing unit in the claims. The spectral movement calculation unit 13 in the above embodiments is equivalent to a spectral movement calculation unit in the claims. The interpolation band determining unit 15 in the above embodiments is equivalent to an interpolation band determination unit in the claims. The spectrum interpolation unit 16 in the above embodiments is equivalent to a spectrum interpolation unit in the claims. The time-frequency transforming unit 12 in the above embodiments is equivalent to a transforming unit in the claims. And the spectrum decoding unit 22 in the above embodiment is equivalent to a decoding unit in the claims.

The present invention is not limited to the specifically disclosed embodiments, and variations and modifications may be made without departing from the scope of the present invention.

What is claimed is:

1. An audio signal interpolation method comprising:

determining a spectral movement which is indicative of a difference in each of spectral components between a frequency spectrum of a current frame of an input audio signal and a frequency spectrum of a previous frame of the input audio signal stored in a spectrum storing unit;

determining a frequency band which is to be interpolated, by using the frequency spectrum of the current frame and the spectral movement; and performing interpolation of spectral components in said frequency band for the current frame by using either the frequency spectrum of the current frame or the frequency spectrum of the previous frame, wherein an amount of movement of spectral components from the previous frame to the current frame is determined as being the spectral movement, and, when an amplitude of said spectral components is below a first threshold and a decrease of the amplitude of said spectral components from the previous frame to the current frame is above a second threshold, a frequency band of said spectral components is determined as being the frequency band which is to be interpolated.

2. An audio signal interpolation device comprising:

a spectral movement calculation unit determining a spectral movement which is indicative of a difference in each of spectral components between a frequency spectrum of a current frame of an input audio signal and a frequency spectrum of a previous frame of the input audio signal stored in a spectrum storing unit;

an interpolation band determination unit determining a frequency band which is to be interpolated, by using the frequency spectrum of the current frame and the spectral movement; and a spectrum interpolation unit performing interpolation of spectral components in said frequency band for the current frame by using either the frequency spectrum of the current frame or the frequency spectrum of the previous frame, wherein the spectral movement calculation unit determines an amount of movement of spectral components from the previous frame to the current frame as being the spectral movement, and, when an amplitude of said spectral components is below a first threshold and a decrease of the amplitude of said spectral components from the previous frame to the current frame is above a second threshold, the interpolation band determination unit determines a frequency band of said spectral components as being the frequency band which is to be interpolated.

3. The audio signal interpolation device according to claim 2, wherein the spectral movement calculation unit determines a difference between an amount of movement of spectral components from a preceding frame to the previous frame and an amount of movement of spectral components from the previous frame to the current frame as the spectral movement, and the interpolation band determination unit determines a frequency band of the spectral components as the frequency band to be interpolated when an amplitude of the spectral components is below a first threshold and the spectral movement is above a third threshold.

4. The audio signal interpolation device according to claim 2, wherein the spectral movement calculation unit determines, as the spectral movement, a difference between a difference in amplitude between a spectral component of concern and an adjacent spectral component in the previous frame and a difference in amplitude between the spectral component of concern and the adjacent spectral component in the current frame, and the interpolation band determination unit determines a frequency band of the spectral component of concern as the frequency band to be interpolated when an amplitude of the spectral component of concern is below a first threshold and the spectral movement is above a fourth threshold.

5. The audio signal interpolation device according to claim 2, wherein the spectrum interpolation unit performs interpolation of spectral components in the determined frequency band for the current frame by using spectral components of a frequency band in the current frame which is the same as the determined frequency band in the previous frame.

6. The audio signal interpolation device according to claim 2, wherein the spectrum interpolation unit performs interpolation of spectral components in the determined frequency band for the current frame by using spectral components in a frequency band adjacent to a low-frequency-side frequency band of the current frame.

7. The audio signal interpolation device according to claim 2, further comprising a transforming unit which transforms an input time-domain audio signal into a frequency-domain audio signal, and supplies the frequency-domain audio signal to the spectral movement calculation unit as the frequency spectrum of the current frame.

8. The audio signal interpolation device according to claim 2, further comprising a decoding unit which decodes encoded audio data to generate a frequency-domain audio signal, and supplies the frequency-domain audio signal to the spectral movement calculation unit as the frequency spectrum of the current frame.

9. The audio signal interpolation device according to claim 2, wherein the first threshold is set up as a variable threshold so that a value of the first threshold for a low-frequency side frequency spectrum is smaller than a value of the first threshold for a high-frequency side frequency spectrum.

10. The audio signal interpolation device according to claim 2, wherein, after the spectral movement of the current frame is determined by the spectral movement calculation unit, the spectral movement calculation unit stores the frequency spectrum of the current frame into the spectrum storing unit.

11. The audio signal interpolation device according to claim 2, wherein the spectrum interpolation unit stores, into the spectrum storing unit, the frequency spectrum of the current frame to which the interpolation of spectral components is performed by the spectrum interpolation unit.

12. The audio signal interpolation device according to claim 2, wherein the second threshold is set up as a variable threshold so that a value of the second threshold for a low-frequency side frequency spectrum is smaller than a value of the second threshold for a high-frequency side frequency spectrum.

13. The audio signal interpolation device according to claim 3, wherein the third threshold is set up as a variable threshold so that a value of the third threshold for a low-frequency side frequency spectrum is smaller than a value of the third threshold for a high-frequency side frequency spectrum.

14. The audio signal interpolation device according to claim 4, wherein the fourth threshold is set up as a variable threshold so that a value of the fourth threshold for a low-frequency side frequency spectrum is smaller than a value of the fourth threshold for a high-frequency side frequency spectrum.

15. The audio signal interpolation device according to claim 4, wherein each of the first threshold and the fourth threshold is set up to have a dynamically changed value such that a value of each threshold is changed according to an average power of the input audio signal over all bands of the frequency spectrum of the current frame.

* * * * *